US011274269B2

(12) United States Patent
Segler et al.

(10) Patent No.: US 11,274,269 B2
(45) Date of Patent: Mar. 15, 2022

(54) SOLID FRAGRANCE-CONTAINING COMPOSITION

(71) Applicant: Henkel AG & Co. KGaA, Duesseldorf (DE)

(72) Inventors: Tobias Segler, Duesseldorf (DE); Thomas Holderbaum, Hilden (DE); Michael Voelker, Brueggen (DE); Hans-Joachim Schmidt, Dortmund (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/846,486

(22) Filed: Apr. 13, 2020

(65) Prior Publication Data

US 2020/0325421 A1 Oct. 15, 2020

(30) Foreign Application Priority Data

Apr. 12, 2019 (EP) ..... 19168924

(51) Int. Cl.

| | |
|---|---|
| ***C11D 17/00*** | (2006.01) |
| ***C11D 3/50*** | (2006.01) |
| ***C11D 3/20*** | (2006.01) |
| ***C11D 3/22*** | (2006.01) |
| ***C11D 11/00*** | (2006.01) |

(52) U.S. Cl.

CPC ..... *C11D 3/505* (2013.01); *C11D 3/2093* (2013.01); *C11D 3/222* (2013.01); *C11D 11/0082* (2013.01)

(58) Field of Classification Search

CPC ..... C11D 17/0078; C11D 17/0073; C11D 17/041; C11D 3/505; C11D 17/0086; C11D 17/06; C11D 17/042; C11D 17/17; C11D 17/044; C11D 3/2075; C11D 3/50; C11D 17/0091; C11D 1/04; C11D 17/0052

See application file for complete search history.

(56) References Cited

U.S. PATENT DOCUMENTS

| | | | | |
|---|---|---|---|---|
| 6,093,688 | A * | 7/2000 | Gordon | C11D 3/128 252/175 |
| 6,974,789 | B1 * | 12/2005 | Whitaker | C11D 3/046 510/294 |
| 2004/0029764 | A1 * | 2/2004 | Weber | C11D 17/043 510/446 |
| 2006/0116309 | A1 * | 6/2006 | Lambotte | C11D 17/0091 510/302 |

FOREIGN PATENT DOCUMENTS

| | | | |
|---|---|---|---|
| DE | 19953503 | A1 | 5/2001 |
| DE | 102016219292 | A1 | 3/2018 |

OTHER PUBLICATIONS

EP Search Report EP 19168924.9 Completed: Oct. 18, 2019; dated Oct. 28, 2019 5 Pages.

* cited by examiner

*Primary Examiner* — John R Hardee
(74) *Attorney, Agent, or Firm* — Thomas G. Krivulka

(57) ABSTRACT

A solid, particulate composition having at least one water-soluble carrier material, at least one fragrance and at least one rheology modifier from the group of heteroglycans. The carrier material being a water-containing salt (hydrate) of which the water vapor partial pressure, at a specific temperature in the range of from 30 to 100° C., corresponds to the $H_2O$ partial pressure of the saturated solution of this salt, such that the salt melts at this temperature in its own water of crystallization. Furthermore, the invention relates to methods for preparing the solid composition and to a washing or cleaning agent containing the solid composition. Moreover, the present invention also relates to the use of such a washing or cleaning agent for cleaning textiles or hard surfaces and corresponding methods for cleaning textiles or hard surfaces using such a washing or cleaning agent.

20 Claims, No Drawings

SOLID FRAGRANCE-CONTAINING COMPOSITION

FIELD OF THE INVENTION

The present invention relates to a solid, particulate composition comprising at least one water-soluble carrier material, at least one rheology modifier and at least one fragrance, the carrier material being a water-containing salt (hydrate) whose water vapor partial pressure, at a specific temperature in the range of from 30 to 100° C., corresponds to the $H_2O$ partial pressure of the saturated solution of this salt, such that the salt melts at this temperature in its own water of crystallization. Furthermore, the invention relates to methods for preparing the solid composition and to a washing or cleaning agent containing the solid composition. Moreover, the present invention also relates to the use of such a washing or cleaning agent for cleaning textiles or hard surfaces and corresponding methods for cleaning textiles or hard surfaces using such a washing or cleaning agent.

BACKGROUND OF THE INVENTION

When using washing and cleaning agents, the consumer not only aims to wash, clean or care for the objects to be treated, but also wishes that after treatment, for example after washing, the treated objects, such as textiles, have a pleasant smell. For this reason in particular, most commercially available washing and cleaning agents contain fragrances.

Fragrances are often used in the form of fragrance particles, either as an integral component of a washing or cleaning agent, or metered into the washing drum right at the beginning of a wash cycle in a separate form. In this way, the consumer can control the fragrancing of the laundry to be washed by means of individual metering.

The main constituent of such fragrance pastilles known in the prior art is typically a water-soluble or at least water-dispersible carrier polymer, such as polyethylene glycol (PEG), which is used as a vehicle for the integrated fragrances and which dissolves more or less completely in the wash liquor during the washing process, so as to release the fragrances contained and optionally other components into the wash liquor. For the preparation of the known fragrance pastilles, a melt is produced from the carrier polymer, which melt contains the remaining ingredients or these are then added, and the resulting melt is then fed to a shaping process, in the course of which it cools, solidifies and assumes the desired shape.

The known products have the disadvantage that the polymer materials used, in particular PEG, have delayed solubility, which can lead to residues on the laundry or in the washing machine, in particular in the case of short wash cycles, low temperature or other unfavorable conditions.

However, it has now been found that an alternative composition which exhibits a suitable processing range and at the same time has improved water solubility in the usual temperature ranges in which work is carried out can be provided by a water-containing salt (hydrate) being used as the carrier material in a formulation for melting bodies, the water vapor partial pressure of which salt corresponds, at a specific temperature in the range of from 30 to 100° C., to the $H_2O$ partial pressure of the saturated solution of this salt at the same temperature, such that the salt dissolves at this temperature in its own water of crystallization, a process which phenomenologically can be referred to as melting, which, however, is a dissolution process if considered under aspects of thermodynamics. The use of sodium acetate trihydrate is particularly advantageous.

These specific carrier materials are processed preferably by means of a process in the course of which the salts are prepared as melts and subsequently are added dropwise to a cooling belt, for example by means of a nozzle, on which cooling belt the salts solidify and assume a final geometric shape. In the processing, for example, the dropwise adding of the above-mentioned melts to solidified particles, there were technical difficulties with regard to the reliable production of uniform particles having a defined geometry and a sufficient breaking strength for production, packaging and transport. This results in difficulties in the design of the production facility and with regard to achieving a uniform product appearance.

BRIEF SUMMARY OF THE INVENTION

It has been found that these disadvantages can be prevented, irrespective of the duration of the solidification process, by adding specific rheology modifiers to the melt.

In a first aspect, the application is therefore directed to a solid, particulate composition comprising (a) 20 to 95 wt %, based on the total weight of the composition, of at least one water-soluble carrier material selected from water-containing salts whose water vapor partial pressure corresponds, at a specific temperature in the range of from 30 to 100° C., to the $H_2O$ partial pressure of the saturated solution of said salt;

(b) 0.1 to 20 wt % of at least one fragrance;

(c) 0.1 to 10 wt % of at least one rheology modifier from the group of heteroglycans, preferably of such a type and in such an amount that a melt obtained by heating the composition to 70° C. has a yield point above 1 Pa, preferably above 5 Pa and in particular above 10 Pa;

(d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;

(e) optionally up to 25 wt % of at least one solid or filler that is different from (c) and (d); and (f) optionally at least one dye.

The yield point is measured with a rotary rheometer (AR G2 from TA Instruments or a "Kinexus" from Malvern), using a plate-plate measuring system with a diameter of 40 mm and a plate distance of 1.1 mm. The yield point was determined in a step-flow procedure in which the shear stress was increased quasistatically, i.e. by waiting for the equilibrium deformation or steady flow, from the smallest possible value to a value above the yield point. The deformation is plotted against the shear stress in a double logarithmic graph. If a yield point is present, the curves thus obtained have a characteristic deviation. An exclusively elastic deformation takes place below the deviation. The gradient of the curve in the double logarithmic representation is ideally one. Above the deviation, the gradient of the curve suddenly increases and there is steady flow. The shear stress value of the deviation corresponds to the yield point. If the deviation is not very sharp, the point of intersection of the tangents of the two curve portions can be used to determine the yield point. In the case of liquids that have no yield point, the graph described above is usually curved to the right.

In a second aspect, the application is directed to a solid, particulate composition comprising (a) 20 to 95 wt %, based on the total weight of the composition, of at least one water-soluble carrier material selected from water-containing salts whose water vapor partial pressure corresponds, at a specific temperature in the range of from 30 to 100° C., to the $H_2O$ partial pressure of the saturated solution of said salt;

(b) 0.1 to 20 wt % of at least one fragrance;

(c) 0.1 to 10 wt %, preferably 0.1 to 3 wt %, of at least one rheology modifier from the group of
heteroglycans originating from bacteria and/or;
heteroglycans originating from algae and/or;
heteroglycans originating from plants;

(d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;

(e) optionally up to 25 wt % of at least one solid or filler that is different from (c) and (d); and (f) optionally at least one dye.

In various embodiments, the at least one carrier material is used in such an amount that the resulting melt body, i.e. the fragrance pastille, contains from 30 to 95 wt %, preferably from 40 to 90 wt %, for example 45 to 90 wt % of the carrier material, based on the total weight of the melt body.

The solid, particulate composition as described herein is prepared from a solution of the carrier material in the water/water of crystallization contained in the composition, where, for such a solution the term "melt" is also used herein, in contrast to the established use, to denote the state in which the carrier material dissolves by eliminating water in its own water of crystallization and thus forms a liquid. The term "melt" as used herein therefore denotes the liquid state of the composition which results when the temperature at which the carrier material eliminates water of crystallization and then dissolves in the water contained in the composition is exceeded. The invention therefore also relates to the corresponding dispersion containing the herein described (solid) substances dispersed in the melt of the carrier material. Thus, when reference is made below to the solid, particulate composition, the corresponding melt/melt dispersion from which it is obtainable is always included. Since these do not differ in composition except for the physical state, the terms are used interchangeably herein.

The term "melt body" is used herein to describe the solid particles obtainable from the liquid composition upon cooling by solidification/reshaping.

DETAILED DESCRIPTION OF THE INVENTION

The main component of the solid particulate composition as described herein is at least one water-soluble carrier material. The at least one carrier material is characterized in that it is selected from hydrous salts whose water vapor partial pressure, at a temperature in the range of from 30 to 100° C., corresponds to the $H_2O$ partial pressure of the saturated solution of this salt at the same temperature. As a result, the corresponding hydrous salt, also referred to herein as a "hydrate", dissolves on reaching or exceeding this temperature in its own water of crystallization, thereby transitioning from a solid to a liquid physical state. Preferably, the carrier materials according to the invention exhibit this behavior at a temperature in the range of from 40 to 90° C., particularly preferably between 50 and 85° C., even more preferably between 55 and 80° C.

In particular, sodium acetate trihydrate ($Na(CH_3COO).3H_2O$), Glauber's salt ($Na_2SO_4.10H_2O$), trisodium phosphate dodecahydrate ($Na_3PO_4.12H_2O$) and strontium chloride hexahydrate ($SrCl_2.6H_2O$) are included in the previously described water-soluble carrier materials from the group of hydrous salts. The sodium acetate trihydrate ($Na(CH_3COO).3H_2O$) is particularly preferred.

In a third aspect, the application is directed to a solid, particulate composition, comprising, based on the total weight of the composition, (a) 20 to 95 wt % sodium acetate trihydrate;

(b) 0.1 to 20 wt % of at least one fragrance;

(c) 0.1 to 10 wt % of at least one rheology modifier from the group of heteroglycans, preferably of such a type and in such an amount that a melt obtained by heating the composition to 70° C. has a yield point above 1 Pa, preferably above 5 Pa and in particular above 10 Pa;

(d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;

(e) optionally up to 25 wt % of at least one solid or filler that is different from (c) and (d);

(f) optionally at least one dye.

In a fourth aspect, the application is directed to a solid, particulate composition, comprising, based on the total weight of the composition, (a) 20 to 95 wt % sodium acetate trihydrate;

(b) 0.1 to 20 wt % of at least one fragrance;

(c) 0.1 to 10 wt %, preferably 0.1 to 3 wt %, of at least one rheology modifier from the group of
a heteroglycan originating from bacteria and/or;
a heteroglycan originating from algae and/or;
a heteroglycan originating from plants;

(d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;

(e) optionally up to 25 wt % of at least one solid or filler that is different from (c) and (d);

(f) optionally at least one dye.

If the particulate composition is characterized by its content of sodium acetate trihydrate, those compositions are particularly advantageous with regard to their manufacturability, ease of fabrication and handling, which contain the sodium acetate trihydrate in an amount of 30 to 95 wt %, preferably 40 to 90 wt %, in particular from 45 to 90 wt %, based on the total weight of the composition.

A particularly suitable hydrate is sodium acetate trihydrate ($Na(CH_3COO).3H_2O$), since it dissolves in the particularly preferred temperature range of from 55 to 80° C., specifically at approximately 58° C., in its own water of crystallization. The sodium acetate trihydrate can be used directly as such, but it is alternatively also possible to use anhydrous sodium acetate in combination with free water, the trihydrate then forming in situ. In such embodiments, the water is used in a substoichiometric or hyperstoichiometric amount, based on the amount required to convert all the sodium acetate to sodium acetate trihydrate, preferably in an amount of at least 60 wt %, preferably at least 70 wt %, more preferably at least 80 wt %, most preferably 90 wt %, 100 wt % or more, of the amount theoretically required to convert all of the sodium acetate to sodium acetate trihydrate ($Na(CH_3COO).3H_2O$). The hyperstoichiometric use of water is particularly preferred. With respect to the compositions according to the invention, this means that when (anhydrous) sodium acetate is used alone or in combination with a hydrate thereof, preferably the trihydrate, water is also used, the amount of water being at least equal to the amount that would be stoichiometrically required to ensure that at least 60 wt % of the total amount of sodium acetate and its hydrates, preferably at least 70 wt %, more preferably at least 80 wt %, even more preferably at least 90 wt %, most preferably at least 100 wt %, is present in the form of sodium acetate trihydrate. As already described above, it is particularly preferred for the amount of water to exceed the amount that would be theoretically required to convert all of the sodium acetate to the corresponding trihydrate. This means, for example, that a composition containing 50 wt % anhydrous sodium acetate and no hydrate thereof contains at least 19.8 wt % water (60% of 33 wt %, which would be theoretically required to convert all of the sodium acetate to the trihydrate).

A fifth aspect of this application is directed to a solid, particulate composition, comprising, based on the total weight of the composition, (a) 12 to 57 wt % sodium acetate;
(b) 0.1 to 20 wt % of at least one fragrance;
(c) 0.1 to 10 wt % of at least one heteroglycan of such a type and in such an amount that a melt obtained by heating the composition to 70° C. has a yield point above 1 Pa, preferably above 5 Pa and in particular above 10 Pa;
(d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;
(e) optionally up to 25 wt % of at least one solid or filler that is different from (c) and (d); and
(f) optionally at least one dye;
(g) water in an amount that is sufficient to convert at least 60 wt %, preferably at least 70 wt %, more preferably at least 80 wt %, most preferably at least 100 wt %, of the sodium acetate (a) to sodium acetate trihydrate.

A sixth aspect of this application is directed to a solid, particulate composition, comprising, based on the total weight of the composition, (a) 12 to 57 wt % sodium acetate;
(b) 0.1 to 20 wt % of at least one fragrance;
(c) 0.1 to 10 wt %, preferably 0.5 to 3 wt % of at least one rheology modifier from the group of
a heteroglycan originating from bacteria and/or;
a heteroglycan originating from algae and/or;
a heteroglycan originating from plants;
(d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;
(e) optionally up to 25 wt % of at least one solid or filler that is different from (c) and (d); and
(f) optionally at least one dye;
(g) water in an amount that is sufficient to convert at least 60 wt %, preferably at least 70 wt %, more preferably at least 80 wt %, most preferably at least 100 wt %, of the sodium acetate (a) to sodium acetate trihydrate.

If the particulate composition is characterized by its content of sodium acetate, those compositions are particularly advantageous with regard to their manufacturability, ease of fabrication and handling, which contain the sodium acetate in an amount of 18 to 57 wt %, preferably 24 to 48 wt %, in particular from 27 to 45 wt %, based on the total weight of the composition.

In addition to the carrier material a), the solid particulate compositions contain a fragrance b) as the second essential constituent. The weight fraction of the fragrance in the total weight of the composition is preferably 1 to 15 wt %, more preferably 3 to 12 wt %.

A fragrance is a chemical substance that stimulates the sense of smell. In order to be able to stimulate the sense of smell, it should be possible to at least partially distribute the chemical substance in the air, i.e. the fragrance should be volatile at 25° C. at least to a small extent. If the fragrance is very volatile, the odor intensity abates quickly. At a lower volatility, however, the smell is more lasting, i.e. it does not disappear as quickly. In one embodiment, the fragrance therefore has a melting point in the range of from −100° C. to 100° C., preferably from −80° C. to 80° C., more preferably from −20° C. to 50° C., in particular from −30° C. to 20° C. In another embodiment, the fragrance has a boiling point in the range of from 25° C. to 400° C., preferably from 50° C. to 380° C., more preferably from 75° C. to 350° C., in particular from 100° C. to 330° C.

Overall, in order to act as a fragrance, a chemical substance should not exceed a certain molecular weight since, if the molecular weight is too high, the required volatility can no longer be ensured. In one embodiment, the fragrance has a molecular weight of from 40 to 700 g/mol, more preferably from 60 to 400 g/mol.

The odor of a fragrance is perceived by most people as pleasant and often corresponds to the smell of, for example, flowers, fruits, spices, bark, resin, leaves, grasses, mosses and roots. Fragrances can thus also be used to overlay unpleasant odors or even to provide a non-smelling substance with a desired odor. It is possible, for example, to use individual odorant compounds, such as the synthetic products of the ester, ether, aldehyde, ketone, alcohol and hydrocarbon types, as fragrances.

Fragrance compounds of the aldehyde type are, for example, adoxal (2,6,10-trimethyl-9-undecenal), anisaldehyde (4-methoxybenzaldehyde), cymene (3-(4-isopropylphenyl)-2-methylpropanal), ethylvanillin, florhydral (3-(3-isopropylphenyl)butanal), helional (3-(3,4-methylenedioxyphenyl)-2-methylpropanal), heliotropin, hydroxycitronellal, lauraldehyde, lyral (3- and 4-(4-hydroxy-4-methylpentyl)-3-cyclohexene-1-carboxaldehyde), methylnonylacetaldehyde, lilial (3-(4-tert-butylphenyl)-2-methylpropanal), phenylacetaldehyde, undecylenealdehyde, vanillin, 2,6,10-trimethyl-9-undecenal, 3-dodecen-1-al, alpha-n-amylcinnamaldehyde, melonal (2,6-dimethyl-5-heptenal), 2,4-di-methyl-3-cyclohexene-1-carboxaldehyde (triplal), 4-methoxybenzaldehyde, benzaldehyde, 3-(4-tert-butylphenyl)-propanal, 2-methyl-3-(para-methoxyphenyl) propanal, 2-methyl-4-(2,6,6-trimethyl-2(1)-cyclohexen-1-yl)butanal, 3-phenyl-2-propenal, cis-/trans-3,7-dimethyl-2,6-octadien-1-al, 3,7-dimethyl-6-octen-1-al, [(3,7-dimethyl- 6-octenyl)oxy]acetaldehyde, 4-isopropylbenzylaldehyde, 1,2,3,4,5,6,7,8-octahydro-8,8-dimethyl-2-naphthaldehyde, 2,4-dimethyl-3-cyclohexene-1-carboxaldehyde, 2-methyl-3-(isopropylphenyl)propanal, 1-decanal, 2,6-dimethyl-5-heptenal, 4-(tricyclo[5.2.1.0(2,6)]-decylidene-8)-butanal, octahydro-4,7-methane-1H-indenecarboxaldehyde, 3-ethoxy-4-hydroxybenzaldehyde, para-ethyl-alpha, alpha-dimethylhydrocinnamaldehyde, alpha-methyl-3,4-(methylenedioxy)-hydrocinnamaldehyde, 3,4-methylenedioxybenzaldehyde, alpha-n-hexylcinnamaldehyde, m-cymene-7-carboxaldehyde, alpha-methylphenylacetaldehyde, 7-hydroxy-3,7-dimethyloctanal, undecenal, 2,4,6-trimethyl-3-cyclohexene-1-carboxaldehyde, 4-(3)(4-methyl-3-pentenyl)-3-cyclohexene carboxaldehyde, 1-dodecanal, 2,4-dimethylcyclohexene-3-carboxaldehyde, 4-(4-hydroxy-4-methylpentyl)-3-cyclohexene-1-carboxaldehyde, 7-methoxy-3,7-dimethyloctan-1-al, 2-methyl-undecanal, 2-methyldecanal, 1-nonanal, 1-octanal, 2,6,10-trimethyl-5,9-undecadienal, 2-methyl-3-(4-tert-butyl)propanal, dihydrocinnamaldehyde, 1-methyl-4-(4-methyl-3-pentenyl)-3-cyclohexene-1-carboxaldehyde, 5- or 6-methoxyhexahydro-4,7-methanindan-1- or 2-carboxaldehyde, 3,7-dimethyloctan-1-al, 1-undecanal, 10-undecen-1-al, 4-hydroxy-3-methoxybenzaldehyde, 1-methyl-3-(4-methylpentyl)-3-cyclohexenecarboxaldehyde, 7-hydroxy-3J-dimethyloctanal, trans-4-decenal, 2,6-nonadienal, para-tolylacetaldehyde, 4-methylphenylacetaldehyde, 2-methyl-4-(2,6,6-trimethyl-1-cyclohexen-1-yl)-2-butenal, ortho-methoxycinnamaldehyde, 3,5,6-trimethyl-3-cyclohexenecarboxaldehyde, 3J-dimethyl-2-methylene-6-octenal, phenoxyacetaldehyde, 5,9-dimethyl-4,8-decadienal, peonyaldehyde (6,10-dimethyl-3-oxa-5,9-undecadien-1-al), hexahydro-4,7-methanindan-1-carboxaldehyde, 2-methyloctanal, alpha-methyl-4-(1-methylethyl)benzeneacetaldehyde, 6,6-dimethyl-2-norpinene-2-propionaldehyde, para-methylphenoxyacetaldehyde, 2-methyl-3-phenyl-2-propen-1-al, 3,5,5-trimethylhexanal, hexahydro-8,8-dimethyl-2-naphthaldehyde, 3-propyl-bicyclo-[2.2.1]-hept-5-ene-2-carbaldehyde, 9-decenal, 3-methyl-5-phenyl-1-pentanal, methylnonylacetaldehyde, hexanal and trans-2-hexenal.

Fragrance compounds of the ketone type are, for example, methyl-beta-naphthyl ketone, musk indanone (1,2,3,5,6,7-hexahydro-1,1,2,3,3-pentamethyl-4H-inden-4-one), tonalide (6-acetyl-1,1,2,4,4,7-hexamethyltetralin), alpha-damascone, beta-damascone, delta-damascone, iso-damascone, damascenone, methyldihydrojasmonate, menthone, carvone, camphor, Koavone (3,4,5,6,6-pentamethylhept-3-en-2-one), fenchone, alpha-ionone, beta-ionone, gamma-methyl-ionone, fleuramone (2-heptylcyclopentanone), dihydrojasmone, cis-jasmone, Iso-E-Super (1-(1,2,3,4,5,6J,8-octahydro-2,3,8,8-tetramethyl-2-naphthalenyl)-ethan-1-one (and isomers)), methyl cedrenyl ketone, acetophenone, methyl acetophenone, para-methoxy acetophenone, methyl beta-naphthyl ketone, benzyl acetone, benzophenone, para-hydroxyphenyl butanone, celery ketone (3-methyl-5-propyl-2-cyclohexenone), 6-isopropyldecahydro-2-naphthone, dimethyloctenone, frescomenthe (2-butan-2-yl-cyclohexan-1-one), 4-(1-ethoxyvinyl)-3,3,5,5-tetramethylcyclohexanone, methylheptenone, 2-(2-(4-methyl)-3-cyclohexen-1-yl)propyl)cyclopentanone, 1-(p-menthen-6(2)-yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)-indanone, 4-damascol, dulcinyl (4-(1,3-benzodioxol-5-yl)butan-2-one), hexalone (1-(2,6,6-trimethyl-2-cyclohexen-1-yl)-1,6-heptadien-3-one), isocyclemone E (2-acetonaphthone-1,2,3,4,5,6,7,8-octahydro-2,3,8,8-tetramethyl), methyl nonylketone, methylcyclocitrone, methyl lavender ketone, orivone (4-tert-amylcyclohexanone), 4-tert-butylcyclohexanone, delphone (2-pentyl-cyclopentanone), muscone (CAS 541-91-3), neobutenone (1-(5,5-dimethyl-1-cyclohexenyl)pent-4-en-1-one), plicatone (CAS 41724-19-0), veloutone (2,2,5-trimethyl-5-pentylcyclopentan-1-one), 2,4,4,7-tetramethyl-oct-6-en-3-one and tetramerane (6,10-dimethylundecen-2-one).

Fragrance compounds of the alcohol type are, for example, 10-undecen-1-ol, 2,6-dimethylheptan-2-ol, 2-methylbutanol, 2-methylpentanol, 2-phenoxyethanol, 2-phenylpropanol, 2-tert-butycyclohexanol, 3,5,5-trimethylcyclohexanol, 3-hexanol, 3-methyl-5-phenyl-pentanol, 3-octanol, 3-phenyl-propanol, 4-heptenol, 4-isopropylcyclohexanol, 4-tert-butycyclohexanol, 6,8-dimethyl-2-nonanol, 6-nonen-1-ol, 9-decen-1-ol, α-methylbenzyl alcohol, α-terpineol, amyl salicylate, benzyl alcohol, benzyl salicylate, β-terpineol, butyl salicylate, citronellol, cyclohexyl salicylate, decanol, dihydromyrcenol, dimethylbenzylcarbinol, dimethylheptanol, dimethyloctanol, ethyl salicylate, ethylvanillin, eugenol, farnesol, geraniol, heptanol, hexyl salicylate, isoborneol, isoeugenol, isopulegol, linalool, menthol, myrtenol, n-hexanol, nerol, nonanol, octanol, p-menthan-7-ol, phenylethyl alcohol, phenol, phenyl salicylate, tetrahydrogeraniol, tetrahydrolinalool, thymol, trans-2-cis-6-nonadicnol, trans-2-nonen-1-ol, trans-2-octenol, undecanol, vanillin, champiniol, hexenol and cinnamyl alcohol.

Fragrance compounds of the ester type are, for example, benzyl acetate, phenoxyethyl isobutyrate, p-tert-butylcyclohexyl acetate, linalyl acetate, dimethylbenzylcarbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, floramate, melusate, and jasmacyclate.

Ethers include, for example, benzyl ethyl ether and ambroxan. Hydrocarbons mainly include terpenes such as limonene and pinene.

Preferably, mixtures of different fragrances are used, which together produce an appealing fragrance note. Such a mixture of fragrances may also be referred to as fragrance or fragrance oil. Fragrance oils of this kind may also contain natural fragrance mixtures, such as those obtainable from plant sources.

Fragrances originating from plants include essential oils, such as angelica root oil, aniseed oil, arnica blossom oil, basil oil, bay oil, champaca blossom oil, citrus oil, abies alba oil, abies alba cone oil, elemi oil, eucalyptus oil, fennel oil, spruce needle oil, galbanum oil, geranium oil, ginger grass oil, guaiac wood oil, gurjun balsam oil, helichrysum oil, ho oil, ginger oil, iris oil, jasmine oil, cajeput oil, calamus oil, chamomile oil, camphor oil, cananga oil, cardamom oil, cassia oil, pine needle oil, copaiba balsam oil, coriander oil, spearmint oil, caraway oil, cumin oil, labdanum oil, lavender oil, lemon grass oil, lime blossom oil, lime oil, mandarin oil, melissa oil, mint oil, musk seed oil, muscatel oil, myrrh oil, clove oil, neroli oil, niaouli oil, olibanum oil, orange blossom oil, orange peel oil, oregano oil, palmarosa oil, patchouli oil, balsam Peru oil, petitgrain oil, pepper oil, peppermint oil, allspice oil, pine oil, rose oil, rosemary oil, sage oil, sandalwood oil, celery oil, spike lavender oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil, and ambrettolide, Ambroxan, alpha-amylcinnamaldehyde, anethole, anisaldehyde, anise alcohol, anisole, anthranilic acid methyl ester, acetophenone, benzylacetone, benzaldehyde, benzoic acid ethyl ester, benzophenone, benzyl alcohol, benzyl acetate, benzyl benzoate, benzyl formate, benzyl valerianate, borneol, bornyl acetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptyne carboxylic acid methyl ester, heptaldehyde, hydroquinone dimethyl ether, hydroxycinnamaldehyde, hydroxycinnamyl alcohol, indole, irone, isoeugenol, isoeugenol methyl ether, isosafrole, jasmine, camphor, carvacrol, carvone, p-cresol methyl ether, coumarin, p-methoxyacetophenone, methyl n-amyl ketone, methylanthranilic acid methyl ester, p-methylacetophenone, methylchavicol, p-methylquinoline, methyl beta-naphthyl ketone, methyl n-nonylacetaldehyde, methyl n-nonyl ketone, muscone, beta-naphthol ethyl ether, beta-naphthol methyl ether, nerol, n-nonylaldehyde, nonyl alcohol, n-octylaldehyde, p-oxy-acetophenone, pentadecanolide, beta-phenethyl alcohol, phenylacetic acid, pulegone, safrole, salicylic acid isoamyl ester, salicylic acid methyl ester, salicylic acid hexyl ester, salicylic acid cyclohexyl ester, santalol, sandelice, skatole, terpineol, thyme, thymol, troenan, gamma-undecalactone, vanillin, veratraldehyde, cinnamaldehyde, cinnamyl alcohol, cinnamic acid, cinnamic acid ethyl ester, cinnamic acid benzyl ester, diphenyl oxide, limonene, linalool, linalyl acetate and propionate, melusate, menthol, menthone, methyl-n-heptenone, pinene, phenylacetaldehyde, terpinyl acetate, citral, citronellal and mixtures thereof.

For the prolongation of the active substance effect, in particular the prolonged fragrance effect, it has proven to be advantageous to encapsulate the active substance c), in particular the fragrance. In a corresponding embodiment, at least part of the fragrance is used in encapsulated form (fragrance capsules), in particular in microcapsules. However, it is also possible to use the entire fragrance in encapsulated form. The microcapsules may be water-soluble and/or water-insoluble microcapsules. For example, melamine-urea-formaldehyde microcapsules, melamine-formaldehyde microcapsules, urea-formaldehyde microcapsules or starch microcapsules can be used. "Fragrance precursor" refers to compounds that release the actual fragrance only after chemical conversion/cleavage, typically by exposure to light or other environmental conditions such as pH, temperature, etc. Such compounds are often also referred to as fragrance storage substances or "pro-fragrances."

For the later effect of the composition, it has proven to be advantageous if the fragrance is selected from the group of fragrance oils and fragrance capsules. The use of a combination of fragrance oil and fragrance capsules is very particularly preferred.

As a third essential component, the solid particulate composition contains a rheology modifier from the group of heteroglycans. The weight fraction of the rheology modifier in the total weight of the composition is preferably 1 to 2.5 wt %, more preferably 1.2 to 2.0 wt %.

Heteroglycans are polysaccharides that are made up of more than one type of single monomeric sugar.

In principle, heteroglycans of any origin can be used, but what is preferred is the use of:

heteroglycans originating from bacteria and/or;

heteroglycans originating from algae and/or;

heteroglycans originating from plants.

The use of heteroglycans originating from bacteria has proven to be technically particularly advantageous. Corresponding heteroglycans can be obtained, for example, by bacterial fermentation. The heteroglycan is preferably an exopolysaccharide.

For reasons of manufacturability, ease of fabrication, handling and dosing of the solid particulate composition those heteroglycans are preferred, which are functionalized with at least one non-saccharidic group, preferably with at least one non-saccharidic group selected from acetate, pyruvate, phosphate and succinate. Compounds with the INCI name succinoglycan are very particularly preferred as the rheology modifier.

The optional components (d) and (e) are preferably contained independently of one another in amounts of up to 20 wt %, more preferably up to 18 wt %, in particular up to 15 wt %, based on the total weight of the composition.

Further preferred optional constituents include moulded bodies containing active substances, dyes, preservatives, bitter substances or buffer systems.

In order to improve the aesthetic impression of the moulded bodies containing active substance, they preferably comprise at least one dye. It is preferred that the moulded bodies comprise at least one water-soluble dye, particularly preferably a water-soluble polymer dye. Such dyes are known in the art and are typically used in concentrations of from 0.001 to 0.5 wt %, preferably 0.01 to 0.3 wt %, based on the total weight of the composition.

Preferred dyes, which can be selected by a person skilled in the art without any difficulty at all, should be highly stable in storage, unaffected by the other ingredients of the washing or cleaning agent, insensitive to light and should not exhibit pronounced substantivity with respect to textile fibers in order to avoid dyeing said fibers.

The dye is a conventional dye which can be used for various washing or cleaning agents. The dye is preferably selected from Acid Red 18 (CI 16255), Acid Red 26, Acid Red 27, Acid Red 33, Acid Red 51, Acid Red 87, Acid Red 88, Acid Red 92, Acid Red 95, Acid Red 249 (CI 18134), Acid Red 52 (CI 45100), Acid Violet 126, Acid Violet 48, Acid Violet 54, Acid Yellow 1, Acid Yellow 3 (CI 47005), Acid Yellow 11, Acid Yellow 23 (CI 19140), Acid Yellow 3, Direct Blue 199 (CI 74190), Direct Yellow 28 (CI 19555), Food Blue 2 (CI 42090), Food Blue 5:2 (CI 42051:2), Food Red 7(01 16255), Food Yellow 13 (CI 47005), Food Yellow 3 (CI 15985), Food Yellow 4 (CI 19140), Reactive Green 12 and Solvent Green 7 (CI 59040).

Particularly preferred dyes are water-soluble acid dyes, for example Food Yellow 13 (Acid Yellow 3, CI 47005), Food Yellow 4 (Acid Yellow 23, CI 19140), Food Red 7 (Acid Red 18, CI 16255), Food Blue 2 (Acid Blue 9, CI 42090), Food Blue 5 (Acid Blue 3, CI 42051), Acid Red 249 (CI 18134), Acid Red 52 (CI 45100), Acid Violet 126, Acid Violet 48, Acid Blue 80(01 61585), Acid Blue 182, Acid Blue 182, Acid Green 25 (CI 61570) and Acid Green 81.

Water-soluble direct dyes, for example Direct Yellow 28 (CI 19555) and Direct Blue 199 (CI 74190), and water-soluble reactive dyes, for example Reactive Green 12, and the dyes Food Yellow 3 (CI 15985) and Acid Yellow 184 are equally preferably used. Aqueous dispersions of the following pigment dyes are equally preferably used: Pigment Black 7 (CI 77266), Pigment Blue 15 (CI 74160), Pigment Blue 15:1 (CI 74160), Pigment Blue 15:3 (CI 74160), Pigment Green 7 (CI 74260), Pigment Orange 5, Pigment Red 112 (CI 12370), Pigment Red 112 (CI 12370), Pigment Red 122 (CI 73915), Pigment Red 179 (CI 71130), Pigment Red 184 (CI 12487), Pigment Red 188 (CI 12467), Pigment Red 4 (CI 12085), Pigment Red 5 (CI 12490), Pigment Red 9, Pigment Violet 23 (CI 51319), Pigment Yellow 1 (CI 28 11680), Pigment Yellow 13 (CI 21100), Pigment Yellow 154, Pigment Yellow 3 (CI 11710), Pigment Yellow 74, Pigment Yellow 83 (CI 21108) and Pigment Yellow 97. In preferred embodiments, the following pigment dyes are used in the form of dispersions: Pigment Yellow 1 (CI 11680), Pigment Yellow 3 (CI 11710), Pigment Red 112 (CI 12370), Pigment Red 5 (CI 12490), Pigment Red 181 (CI 73360), Pigment Violet 23 (CI 51319), Pigment Blue 15:1 (CI 74160), Pigment Green 7 (CI 74260) and Pigment Black 7 (CI 77266).

In equally preferred embodiments, water-soluble polymer dyes are used, for example Liquitint, Liquitint Blue HP, Liquitint Blue MC, Liquitint Blue 65, Liquitint Cyan 15, Liquitint Patent Blue, Liquitint Violet 129, Liquitint Royal Blue, Liquitint Experimental Yellow 8949-43, Liquitint Green HMC, Liquitint Yellow LP, Liquitint Yellow II and mixtures thereof.

The group of more particularly preferred dyes includes Acid Blue 3, Acid Yellow 23, Acid Red 33, Acid Violet 126, Liquitint Yellow LP, Liquitint Cyan 15, Liquitint Blue HP and Liquitint Blue MC.

The addition of bitter substances primarily serves to avoid oral intake of the moulded bodies containing the active substance.

Preferred moulded bodies contain at least one bitter substance in an amount of 0.0001 to 0.05 wt %, based on the total weight of the composition. Amounts of 0.0005 to 0.02 wt % are particularly preferred. According to the present invention, those bitter substances are particularly preferred which are soluble in water at 20° C. to at least 5 g/l. With regard to an undesired interaction with the fragrance components also contained in the composition, in particular a change in the fragrance note perceived by the consumer, the ionogenic bitter substances have proven to be superior to the nonionogenic ones. Ionogenic bitter substances consisting of organic cation(s) and organic anion(s) are consequently preferred for the composition according to the invention.

In various embodiments, the at least one bitter substance is therefore an ionogenic bitter substance.

Quaternary ammonium compounds which contain an aromatic group both in the cation and in the anion are outstandingly suitable in the context of the present invention. In various embodiments, the at least one bitter substance is therefore a quaternary ammonium compound.

A suitable quaternary ammonium compound is, for example, without limitation, the benzyldiethyl ((2,6-xylylcarbamoyl) methyl) ammonium benzoate commercially available, for example, under the trademarks Bitrex® and Indigestin®. This compound is also known as Denatonium benzoate. In various embodiments, the at least one bitter substance is benzyldiethyl ((2,6-xylylcarbamoyl) methyl) ammonium benzoate (Bitrex®). If Bitrex® is used, weight fractions of 0.0001 to 0.05 wt % are preferred. The information is based on the active substance content and the total weight.

The composition further contains at least one buffer system as defined above. The buffer system is preferably solid, i.e. it is a solid (mixture) under standard conditions. The term "buffer capacity" refers to the amount of hydrogen chloride (HCl) in mg that is necessary to adjust the pH of a solution of 1 g of the solid composition in 50 g of deionized water under standard conditions (20° C., 1013 mbar) to drop to below 6.75. The buffer systems used according to the invention are preferably distinguished by the fact that they have a pKa value of at least 5.75, preferably at least 6.25, more preferably at least 6.75, and preferably not more than 12, more preferably less than 11.5, even more preferably 11 or less, most preferably 10.5 or less. The buffering capacity of the resulting solution is preferably at least 2 mg HCl/g composition, preferably at least 3 mg HCl/g composition, more preferably at least 4 mg HCl/g composition.

Suitable buffer substances are, for example, without limitation, sodium hydrogen carbonate, sodium carbonate, disodium hydrogen phosphate, sodium glutamate, sodium aspartate, tris(hydroxymethyl)aminomethane (TRIS) and other organic and inorganic buffer substances known in the art which meet the above criteria, and mixtures of the aforementioned. TRIS is particularly preferred.

The buffer substances in the compositions according to the invention are used, for example, in amounts of 0.1 to 10 wt %, preferably 0.5 to 7.5 wt %, more preferably 1 to 5 wt %, in each case based on the total weight of the composition and are preferably selected from sodium hydrogen carbonate, sodium carbonate, disodium hydrogen phosphate, sodium glutamate, sodium aspartate, tris(hydroxymethyl) aminomethane (TRIS) and combinations thereof.

Preferably, the composition does not contain polyethylene glycol (PEG) that is solid at room temperature (25° C.) in the form of a coating, more preferably the composition does not contain any PEG that is solid at room temperature (25° C.), i.e., the content of PEG that is solid at room temperature (25° C.) is less than 1 wt % based on the composition.

As stated at the outset, the compositions according to the invention are distinguished by comparison with the known compositions of the prior art by an improved solubility profile and an improved fragrance effect. At the same time, however, these compositions tend to produce unesthetic "salt efflorescence" on their surface, depending on the exact manufacturing and/or storage conditions. These particle surface changes particularly affect the appearance of dye-containing compositions. Another object was therefore to prevent or at least mitigate this efflorescence by means of choosing a specific formulation.

Surprisingly, it has been found that the above-described unesthetic surface changes of the compositions can be prevented by the addition of at least one water-miscible organic solvent. For this reason, the compositions according to the invention contain at least one water-miscible organic solvent as another essential constituent.

The water-miscible organic solvents are preferably less volatile and odorless. Suitable water-miscible organic solvents are, for example, monohydric and polyhydric alcohols, alkyl ethers, dimolecular or low-molecular-weight polyalkylene ethers which are liquid at room temperature. The solvents are preferably selected from ethanol, n-propanol, i-propanol, butanols, glycol, propanediol, butanediol, methylpropanediol, diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether (1,2-propanediol) and mixtures of these solvents.

Particular preference is given to dipropylene glycol, 1,2-propylene glycol and glycerol, since they are particularly readily miscible with water and also do not undergo any adverse reactions with the other constituents of the composition. Dipropylene is particularly preferred.

The proportion by weight of the water-miscible organic solvent with respect to the total weight of the composition is preferably 0.1 to 20 wt %, preferably 0.1 to 10 wt %, particularly preferably 0.5 to 8 wt %, and in particular 1 to 6 wt %.

As described above, the composition may potentially also contain free water. The term "free water" as used herein denotes water which is not bound as water of crystallization in any of the salts contained in the composition.

The solid, particulate composition can have any shape. For reasons of manufacturability, ease of fabrication, handling and dosing, preference is given to spherical, figurative, scale, cuboid, cylindrical, conical, spherical cap or lenticular, hemispherical, disk-like or needle-shaped particles. Exemplary particles can have a gummy bear-like, figurative design. On account of their ease of fabrication and their performance profile, hemispherical particles are particularly preferred.

It is furthermore preferred for the composition to consist of at least 20 wt %, preferably at least 40 wt %, particularly preferably at least 60 wt % and more particularly preferably at least 80 wt % of particles which have a spatial extension of from 0.5 to 10 mm, in particular 0.8 to 7 mm and particularly preferably 1 to 5 mm, in any spatial direction.

Preferably, at least 20 wt %, preferably at least 40 wt %, particularly preferably at least 60 wt % and especially particularly preferably at least 80 wt % of the composition consists of particles in which the ratio of the longest particle diameter determined in any spatial direction to the shortest diameter determined in any spatial direction is between 3:1 and 1:1, preferably between 2.5:1 and 1.2:1 and in particular between 2.2:1 and 1.4:1.

The weight of the solid particles of the composition can also vary within wide limits. With regard to the manufacturability and dosing properties, however, those compositions have proven to be advantageous which consist at least 20 wt %, preferably at least 40 wt %, particularly preferably at least 60 wt % and especially particularly preferably at least 80 wt % of particles which have a particle weight between 2 and 150 mg, preferably between 8 and 120 mg and in particular between 20 and 100 mg.

As mentioned at the beginning, the composition is primarily suitable for scenting textiles. The use of the solid composition as a textile care agent for scenting textile fabrics is therefore a further aspect of this application. The solid particulate composition can be marketed or used alone or in combination with another preparation. In a preferred embodiment, the solid particulate composition is part of a washing or cleaning agent.

A composition as described herein may be used for example in the wash cycle of a laundry cleaning process and thus may transport the fragrance to the laundry right at the beginning of the washing process. Furthermore, the composition is easier and better to handle than liquid compositions since, during subsequent storage of the bottle, no drops are left on the edge of the bottle that run down to the edges on the ground or result in unpleasant deposits in the region of the bottle cap. The same applies to the case in which, during metering, some of the composition is accidentally spilled. The spilled amount can also be removed more easily and cleanly. This application further relates to a method for the treatment of textiles, in the course of which a composition according to the invention or a washing and cleaning agent comprising such a composition is dosed into the wash liquor of a textile washing machine.

The composition of some preferred compositions can be found in the following tables (amounts given in wt % based on the total weight of the agent, unless otherwise indicated).

| | Formula 1 | Formula 2 | Formula 3 | Formula 4 | Formula 5 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 0.1 to 20 | 1.0 to 15 | 1.0 to 15 | 3.0 to 12 |
| Heteroglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 6 | Formula 7 | Formula 8 | Formula 9 | Formula 10 |
|---|---|---|---|---|---|
| Sodium acetate trihydrate | 20 to 95 | 30 to 95 | 30 to 95 | 40 to 90 | 45 to 90 |
| Fragrance oil | 0.1 to 20 | 1.0 to 15 | 1.0 to 15 | 1.0 to 15 | 3.0 to 12 |
| Heteroglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 11 | Formula 12 | Formula 13 | Formula 14 | Formula 15 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 1.0 to 15 | 1.0 to 15 | 1.0 to 15 | 3.0 to 12 |
| Heteroglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 16 | Formula 17 | Formula 18 | Formula 19 | Formula 20 |
|---|---|---|---|---|---|
| Sodium acetate trihydrate | 20 to 95 | 30 to 95 | 30 to 95 | 40 to 90 | 45 to 90 |
| Fragrance oil and fragrance capsules | 0.1 to 20 | 1.0 to 15 | 1.0 to 15 | 1.0 to 15 | 3.0 to 12 |
| Heteroglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 21 | Formula 22 | Formula 23 | Formula 24 | Formula 25 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 1.0 to 15 | 1.0 to 15 | 1.0 to 15 | 3.0 to 12 |
| Heteroglycan originating from bacteria | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

-continued

| | Formula 26 | Formula 27 | Formula 28 | Formula 29 | Formula 30 |
|---|---|---|---|---|---|
| Sodium acetate trihydrate | 20 to 95 | 30 to 95 | 30 to 95 | 40 to 90 | 45 to 90 |
| Fragrance oil | 0.1 to 20 | 1.0 to 15 | 1.0 to 15 | 1.0 to 15 | 3.0 to 12 |
| Heteroglycan originating from bacteria | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 31 | Formula 32 | Formula 33 | Formula 34 | Formula 35 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 1.0 to 15 | 1.0 to 15 | 1.0 to 15 | 3.0 to 12 |
| Heteroglycan originating from bacteria | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 36 | Formula 37 | Formula 38 | Formula 39 | Formula 40 |
|---|---|---|---|---|---|
| Sodium acetate trihydrate | 20 to 95 | 30 to 95 | 30 to 95 | 40 to 90 | 45 to 90 |
| Fragrance oil and fragrance capsules | 0.1 to 20 | 1.0 to 15 | 1.0 to 15 | 1.0 to 15 | 3.0 to 12 |
| Heteroglycan originating from bacteria | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 41 | Formula 42 | Formula 43 | Formula 44 | Formula 45 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 1.0 to 15 | 1.0 to 15 | 1.0 to 15 | 3.0 to 12 |
| Succinoglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 46 | Formula 47 | Formula 48 | Formula 49 | Formula 50 |
|---|---|---|---|---|---|
| Sodium acetate trihydrate | 20 to 95 | 30 to 95 | 30 to 95 | 40 to 90 | 45 to 90 |
| Fragrance oil | 0.1 to 20 | 1.0 to 15 | 1.0 to 15 | 1.0 to 15 | 3.0 to 12 |
| Succinoglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 51 | Formula 52 | Formula 53 | Formula 54 | Formula 55 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 1.0 to 15 | 1.0 to 15 | 1.0 to 15 | 3.0 to 12 |
| Succinoglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 56 | Formula 57 | Formula 58 | Formula 59 | Formula 60 |
|---|---|---|---|---|---|
| Sodium acetate trihydrate | 20 to 95 | 30 to 95 | 30 to 95 | 40 to 90 | 45 to 90 |
| Fragrance oil and fragrance capsules | 0.1 to 20 | 1.0 to 15 | 1.0 to 15 | 1.0 to 15 | 3.0 to 12 |
| Succinoglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 61 | Formula 62 | Formula 63 | Formula 64 | Formula 65 |
|---|---|---|---|---|---|
| Sodium acetate trihydrate | 20 to 95 | 30 to 95 | 30 to 95 | 40 to 90 | 45 to 90 |
| Fragrance | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Heteroglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 66 | Formula 67 | Formula 68 | Formula 69 | Formula 70 |
|---|---|---|---|---|---|
| Sodium acetate trihydrate | 20 to 95 | 30 to 95 | 30 to 95 | 40 to 90 | 45 to 90 |
| Fragrance oil | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Heteroglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

| | Formula 71 | Formula 72 | Formula 73 | Formula 74 | Formula 75 |
|---|---|---|---|---|---|
| Sodium acetate trihydrate | 20 to 95 | 30 to 95 | 30 to 95 | 40 to 90 | 45 to 90 |
| Fragrance capsules | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |

-continued

| | | | | | |
|---|---|---|---|---|---|
| Heteroglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |
| | Formula 76 | Formula 77 | Formula 78 | Formula 79 | Formula 80 |
| Sodium acetate trihydrate | 20 to 95 | 30 to 95 | 30 to 95 | 40 to 90 | 45 to 90 |
| Fragrance oil and fragrance capsules | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Heteroglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |
| | Formula 81 | Formula 82 | Formula 83 | Formula 84 | Formula 85 |
| Sodium acetate trihydrate | 20 to 95 | 30 to 95 | 30 to 95 | 40 to 90 | 45 to 90 |
| Fragrance | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Heteroglycan originating from bacteria | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |
| | Formula 86 | Formula 87 | Formula 88 | Formula 89 | Formula 90 |
| Sodium acetate trihydrate | 20 to 95 | 30 to 95 | 30 to 95 | 40 to 90 | 45 to 90 |
| Fragrance oil | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Heteroglycan originating from bacteria | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |
| | Formula 91 | Formula 92 | Formula 93 | Formula 94 | Formula 95 |
| Sodium acetate trihydrate | 20 to 95 | 30 to 95 | 30 to 95 | 40 to 90 | 45 to 90 |
| Fragrance capsules | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Heteroglycan originating from bacteria | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |
| | Formula 96 | Formula 97 | Formula 98 | Formula 99 | Formula 100 |
| Sodium acetate trihydrate | 20 to 95 | 30 to 95 | 30 to 95 | 40 to 90 | 45 to 90 |
| Fragrance oil and fragrance capsules | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Heteroglycan originating from bacteria | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |
| | Formula 101 | Formula 102 | Formula 103 | Formula 104 | Formula 105 |
| Sodium acetate trihydrate | 20 to 95 | 30 to 95 | 30 to 95 | 40 to 90 | 45 to 90 |
| Fragrance | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Succinoglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |
| | Formula 106 | Formula 107 | Formula 108 | Formula 109 | Formula 110 |
| Sodium acetate trihydrate | 20 to 95 | 30 to 95 | 30 to 95 | 40 to 90 | 45 to 90 |
| Fragrance oil | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Succinoglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |
| | Formula 111 | Formula 112 | Formula 113 | Formula 114 | Formula 115 |
| Sodium acetate trihydrate | 20 to 95 | 30 to 95 | 30 to 95 | 40 to 90 | 45 to 90 |
| Fragrance capsules | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |

-continued

| | | | | | |
|---|---|---|---|---|---|
| Succinoglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |
| | Formula 116 | Formula 117 | Formula 118 | Formula 119 | Formula 120 |
| Sodium acetate trihydrate | 20 to 95 | 30 to 95 | 30 to 95 | 40 to 90 | 45 to 90 |
| Fragrance oil and fragrance capsules | 0.1 to 20 | 1.0 to 15 | 1.0 to 15 | 1.0 to 15 | 3.0 to 12 |
| Water-miscible organic solvent | 0.1 to 20 | 0.1 to 10 | 0.1 to 10 | 0.1 to 10 | 0.5 to 8.0 |
| Succinoglycan | 0.1 to 10 | 0.1 to 10 | 0.1 to 10 | 1 to 2.5 | 1.2 to 2.0 |
| Misc. | up to 100 | up to 100 | up to 100 | up to 100 | up to 100 |

The composition according to the present invention is a solid, particulate composition. The individual particles of the composition can be referred to as melt bodies that are solid at room temperature and temperatures up to 30° C., preferably up to 40° C.

In various embodiments of the invention, the melt bodies according to the invention are coated. Suitable coating agents are, for example, tablet coatings known from pharmaceutical literature. However, the pastilles can also be waxed, i.e. coated with a wax, or, to protect against caking (agglomeration), powder-coated with a powdered material, for example a release agent. It is preferred for the coating not to consist of PEG or to comprise it in any significant amount (>10 wt %, based on the coating).

A method for preparing melt bodies of this kind may comprise the following steps:

(a) producing a melt comprising the at least one water-soluble carrier material;
(b) optionally metering in additional optional ingredients;
(c) Metering in at least one rheology modifier from the group of heteroglycans, at least one fragrance and optionally a dye to the melt;
(d) mixing the melt and the at least one fragrance; and
(e) cooling and optionally reshaping the mixture to obtain fragrance-containing melt bodies.

In a preferred embodiment, the melt dispersion produced in step a) is discharged from the first container by means of a pipeline and fed to the drop former. It is further preferred that the fragrance is continuously introduced into the outlet stream of the first container by means of a further pipeline from a corresponding storage container. A liquid preparation of the fragrance, for example in the form of a solution, is particularly suitable for this. The temperature of the fragrance or the liquid preparation of the fragrance, before being introduced into the outlet stream of the first container, is preferably at least 10° C., preferably at least 20° C. and in particular at least 30° C. below the temperature of the melt dispersion forming the outlet stream.

It is further preferred to mix the resulting mixture in the pipeline after the fragrance has been introduced into the melt dispersion. Mixing is preferably carried out by means of a static mixer, which is located in the pipeline in the direction of flow of the melt dispersion behind the point of entry of the fragrance and before the point of entry of the mixture into the drop former.

The length of the static mixer installed in the pipeline in the flow direction of the melt dispersion is preferably at least 10 times, preferably at least 20 times and in particular at least 50 times the diameter of the pipeline. In order to ensure an optimal mixing of melt dispersion and fragrance, the distance between the end of the static mixer and the entry point of the pipeline into the drop former is less than 500 times, preferably less than 200 times and in particular less than 100 times the diameter of the pipeline. The diameter of the pipeline is the internal diameter without taking into account the wall thickness.

From the pipeline, the mixture of melt dispersion and fragrance enters the drop former having a rotating, perforated outer drum. The section of the pipeline which is located inside the drum of the drop former is referred to below as the feed channel in order to distinguish it from the previously mentioned pipeline. The feed channel preferably extends over at least 80%, particularly preferably over at least 90% and in particular over 100% of the length of the drum of the drop former.

The mixture introduced into the feed channel exits the feed channel, preferably through bores located on the underside of the feed channel, from the feed channel onto a distributor or nozzle bar, which in turn rests on the inside of the rotating, perforated outer drum. The mixture passes through the distributor or nozzle bar and is subsequently applied from the holes in the rotating outer drum to a steel belt located below these holes. The distance between the outside of the rotating, perforated outer drum and the surface of the steel strip is preferably between 5 and 20 mm.

A further mixer can be arranged in the feed channel to further improve the mixing of melt dispersion and fragrance and to prevent or minimize sedimentation. This is preferably a dynamic mixer, for example a helix rotatably arranged within the feed channel.

In order to minimize the thermal load on the fragrance, the residence time of the mixture of melt dispersion and fragrance in the pipeline until it emerges from the rotating, perforated outer drum of the drop former is preferably less than 20 seconds, particularly preferably less than 10 seconds and in particular between 0.5 and 5 seconds.

The viscosity (Texas Instruments AR-G2 rheometer, plate/plate, 4 cm diameter, 1,100 μm column, shear rate 10/1 sec) of the mixture as it exits the rotating, perforated outer drum is preferably between 1,000 and 10,000 mPas.

The droplets of the mixture that are discharged from the drop former are solidified on the steel belt so as to form solid melt bodies. The period of time between the dropping of the mixture onto the steel belt and the complete solidification of the mixture is preferably between 5 and 60 seconds, particularly preferably between 10 and 50 seconds and in particular between 20 and 40 seconds.

The solidification of the mixture is preferably supported and accelerated by cooling. The cooling of the drops applied to the steel belt can be direct or indirect. As direct cooling, for example, cooling by means of cold air can be used. However, indirect cooling of the drops by cooling the lower face of the steel belt using cold water is preferred.

A preferred method therefore comprises the steps:

(a) producing, preferably continuously producing and conveying, a melt comprising the at least one water-soluble carrier material;

(b) optionally metering in additional optional ingredients;

(c) Metering in, preferably continuously metering in the at least one rheology modifier from the group of heteroglycans, the at least one fragrance and optionally a dye into the melt;

(d) Mixing the melt, the rheology modifier and the fragrance;

(e) applying drops of the resulting mixture to a cooling belt by means of a drop former having a rotating, perforated outer drum; and (f) solidifying the drops of the mixture on the steel belt to form solid melt bodies.

In summary, the present invention provides, inter alia:

1. A solid, particulate composition comprising, based on the total weight of the composition,
   a) 20 to 95 wt % of at least one water-soluble carrier material selected from water-containing salts whose water vapor partial pressure corresponds, at a specific temperature in the range of from 30 to 100° C., to the $H_2O$ partial pressure of the saturated solution of said salt;
   b) 0.1 to 20 wt % of at least one fragrance;
   c) 0.1 to 10 wt % of at least one rheology modifier from the group of heteroglycans, preferably of such a type and in such an amount that a melt obtained by heating the composition to 70° C. has a yield point above 1 Pa, preferably above 5 Pa and in particular above 10 Pa;
   d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;
   e) optionally up to 25 wt % of at least one solid or filler that is different from (c) and (d); and
   f) optionally at least one dye.
2. A solid, particulate composition comprising, based on the total weight of the composition,
   a) 20 to 95 wt % of at least one water-soluble carrier material selected from water-containing salts whose water vapor partial pressure corresponds, at a specific temperature in the range of from 30 to 100° C., to the $H_2O$ partial pressure of the saturated solution of said salt;
   b) 0.1 to 20 wt % of at least one fragrance;
   c) 0.1 to 10 wt %, preferably 0.1 to 3 wt %, of at least one rheology modifier from the group of
      heteroglycans originating from bacteria and/or;
      heteroglycans originating from algae and/or;
      heteroglycans originating from plants;
   d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;
   e) optionally up to 25 wt % of at least one solid or filler that is different from (c) and (d); and
   f) optionally at least one dye.
3. The composition according to one of points 1 or 2, characterized in that the water-soluble carrier material is selected from hydrous salts whose water vapor partial pressure, at a temperature in the range of from 40 to 90° C., preferably from 50 to 85° C., more preferably from 55 to 80° C., corresponds to the $H_2O$ partial pressure of the saturated solution of said salt, and is preferably sodium acetate trihydrate ($Na(CH_3COO).3H_2O$).
4. The composition according to one of points 1 to 3, characterized in that the water-soluble carrier material is contained in the composition in an amount of from 30 to 95 wt %, preferably from 40 to 90 wt %, in particular from 45 to 90 wt %, based on the total weight of said composition.
5. A solid, particulate composition comprising, based on the total weight of the composition,
   a) 20 to 95 wt % sodium acetate trihydrate;
   b) 0.1 to 20 wt % of at least one fragrance;
   c) 0.1 to 10 wt % of at least one rheology modifier from the group of heteroglycans, preferably of such a type and in such an amount that a melt obtained by heating the composition to 70° C. has a yield point above 1 Pa, preferably above 5 Pa and in particular above 10 Pa;
   d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;
   e) optionally up to 25 wt % of at least one solid or filler that is different from (c) and (d);
   f) optionally at least one dye; and
   g) water in an amount that is sufficient to convert at least 60 wt %, preferably at least 70 wt %, more preferably at least 80 wt %, most preferably at least 100 wt %, of the sodium acetate (a) to sodium acetate trihydrate.
6. A solid, particulate composition comprising, based on the total weight of the composition,
   a) 20 to 95 wt % sodium acetate trihydrate;
   b) 0.1 to 20 wt % of at least one fragrance;
   c) 0.1 to 10 wt %, preferably 0.1 to 3 wt %, of at least one rheology modifier from the group of
      a heteroglycan originating from bacteria and/or;
      a heteroglycan originating from algae and/or;
      a heteroglycan originating from plants;
   d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;
   e) optionally up to 25 wt % of at least one solid or filler that is different from (c) and (d);
   f) optionally at least one dye; and
   g) water in an amount that is sufficient to convert at least 60 wt %, preferably at least 70 wt %, more preferably at least 80 wt %, most preferably at least 100 wt %, of the sodium acetate (a) to sodium acetate trihydrate.
7. The composition according to one of points 5 or 6, characterized in that the sodium acetate trihydrate is contained in the composition in an amount of from 30 to 95 wt %, preferably from 40 to 90 wt %, in particular from 45 to 90 wt %, based on the total weight of said composition.

8. A solid, particulate composition comprising, based on the total weight of the composition,
   a) 12 to 57 wt % sodium acetate;
   b) 0.1 to 20 wt % of at least one fragrance;
   c) 0.1 to 10 wt % of at least one heteroglycan preferably of such a type and in such an amount that a melt obtained by heating the composition to 70° C. has a yield point above 1 Pa, preferably above 5 Pa and in particular above 10 Pa;
   d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;
   e) optionally up to 25 wt % of at least one solid or filler that is different from (c) and (d); and
   f) optionally at least one dye.
9. A solid, particulate composition comprising:
   a) 12 to 57 wt % sodium acetate;
   b) 0.1 to 20 wt % of at least one fragrance;
   c) 0.1 to 10 wt %, preferably 0.5 to 3 wt % of at least one rheology modifier from the group of
      a heteroglycan originating from bacteria and/or;
      a heteroglycan originating from algae and/or;
      a heteroglycan originating from plants;
   d) optionally up to 25 wt % of an emulsifier, preferably an emulsifier from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof;
   e) optionally up to 25 wt % of at least one solid or filler that is different from (c) and (d); and
   f) optionally at least one dye.
10. The composition according to one of points 8 or 9, characterized in that the sodium acetate is contained in the composition in an amount of from 18 to 57 wt %, preferably from 24 to 48 wt %, in particular from 27 to 45 wt %, based on the total weight of said composition.
11. The composition according to one of the preceding points, characterized in that the at least one fragrance is contained in the composition in an amount of from 1 to 20 wt %, preferably 1 to 15 wt %, more preferably 3 to 12 wt %.
12. The composition according to one of the preceding points, characterized in that the at least one fragrance is used in the form of fragrance capsules and/or fragrance oils.
13. The composition according to one of the preceding points, characterized in that the composition contains, based on its total weight, a rheology modifier from the group of heteroglycans in an amount of from 1 to 2.5 wt %, more preferably 1.2 to 2.0 wt %.
14. Composition according to one of the preceding points, characterized in that the composition contains a heteroglycan originating from bacteria as a rheology modifier.
15. Composition according to one of the preceding points, characterized in that the composition contains a heteroglycan obtained by bacterial fermentation as a rheology modifier.
16. Composition according to one of the preceding points, characterized in that the composition contains an exopolysaccharide as a rheology modifier.
17. Composition according to one of the preceding points, characterized in that the composition contains as a rheology modifier a heteroglycan functionalized with at least one non-saccharidic group, preferably with at least one non-saccharidic group selected from acetate, pyruvate, phosphate and succinate.
18. Composition according to one of the preceding points, characterized in that the composition contains, as a rheology modifier, a compound with the INCI name succinoglycan.
19. The composition according to one of the preceding points, characterized in that components (d) and (e) are, independently of one another, contained therein in amounts of from 0 to 25 wt %, preferably up to 20 wt %, more preferably up to 18 wt %, in particular up to 15 wt %, based on the total weight of the composition.
20. Composition according to one of the preceding points, characterized in that the composition has at least one buffer system, preferably a solid buffer system, in a type and amount such that when 1 g of the composition is dissolved in 50 g of deionized water, a pH of 12, preferably 11.5, more preferably 11, is not exceeded and the buffer capacity of the resulting solution is at least 2 mg HCl/g composition, preferably at least 3 mg HCl/g composition, more preferably at least 4 mg HCl/g composition.
21. Composition according to one of the preceding points, characterized in that the composition 0.1 to 10 wt %, preferably 0.5 to 7.5 wt %, more preferably 1 to 5 wt-% of at least one buffer system, preferably a solid buffer system selected from the group consisting of sodium hydrogen carbonate, sodium carbonate, disodium hydrogen phosphate, sodium glutamate, sodium aspartate, tris (hydroxymethyl) aminomethane (TRIS) and combinations thereof, preferably containing tris (hydroxymethyl) aminomethane.
22. The composition according to one of the preceding points, characterized in that the composition further contains at least one dye, preferably in a concentration of from 0.001 to 0.5 wt %, particularly preferably 0.01 to 0.3 wt %, based on the total weight of the composition.
23. Composition according to one of the preceding points, characterized in that the composition, based on its total weight 0.0001 to 0.05 wt %, preferably 0.0005 to 0.02 wt %, of at least one bitter substance, contains preferably at least one ionic bitter substance, particularly preferably a quaternary ammonium compound.
24. Composition according to one of the preceding points, characterized in that the composition, based on its total weight, contains 0.0001 to 0.05 wt % of benzyldiethyl ((2,6-xylylcarbamoyl) methyl) ammonium benzoate.
25. The composition according to one of the preceding points, characterized in that the composition does not contain a polyethylene glycol which is solid at room temperature (25° C.) in the form of a coating.
26. The composition according to one of the preceding points, characterized in that the composition contains less than 1 wt %, based on the total weight, of a polyethylene glycol which is solid at room temperature (25° C.).
27. The composition according to one of the preceding points, characterized in that the composition further contains free water.
28. The composition according to one of the preceding points, characterized in that the composition contains at least one of a water-miscible organic solvent, based on its total weight, in amounts of 0.1 to 20 wt %, preferably from 0.1 to 10 wt %, preferably 0.5 to 8 wt % and in particular 1 to 6 wt % of at least one water-miscible organic solvent.

29. The composition according to one of the preceding points, characterized in that the composition contains a water-miscible organic solvent from the group dipropylene glycol, 1,2-propylene glycol and glycerol, preferably dipropylene glycol.

30. The composition according to one of the preceding points, characterized in that the composition is in the form of hemispherical particles.

31. The composition according to one of the preceding points, characterized in that at least 20 wt %, preferably at least 40 wt %, particularly preferably at least 60 wt % and especially particularly preferably at least 80 wt % of the composition consists of particles which have a spatial extension of between 0.5 and 10 mm, in particular 0.8 to 7 mm and particularly preferably 1 to 5 mm, in any spatial direction.

32. The composition according to one of the preceding points, characterized in that at least 20 wt %, preferably at least 40 wt %, particularly preferably at least 60 wt % and especially particularly preferably at least 80 wt % of the composition consists of particles in which the ratio of the longest particle diameter determined in any spatial direction to the shortest diameter determined in any spatial direction is between 3:1 and 1:1, preferably between 2.5:1 and 1.2:1 and in particular between 2.2:1 and 1.4:1.

33. The composition according to one of the preceding points, characterized in that at least 20 wt %, preferably at least 40 wt %, particularly preferably at least 60 wt % and especially particularly preferably at least 80 wt % of the composition consists of particles which have a particle weight of between 2 and 150 mg, preferably between 8 and 120 mg and in particular between 20 and 100 mg.

34. A washing or cleaning agent comprising a solid composition according to one of points 1 to 33.

35. The use of a composition according to one of points 1 to 33, or of an agent according to point 34, as a textile-care agent for fragrancing textile fabrics.

36. A method for treating textiles, in the course of which a composition according to one of points 1 to 33, or an agent according to point 34, is metered into the wash liquor of a textile washing machine.

37. A method for preparing the composition according to one of points 1 to 33, comprising:
   a) producing a melt comprising the at least one water-soluble carrier material;
   b) optionally metering in additional optional ingredients;
   c) Metering in the at least one fragrance, the at least one rheology modifier from the group of heteroglycans and optionally a dye into the melt;
   d) mixing the melt and the at least one fragrance; and
   e) cooling and optionally reshaping the mixture to obtain fragrance-containing melt bodies.

38. A method for preparing the composition according to one of points 1 to 33, comprising:
   a) producing, preferably continuously producing and conveying, a melt comprising the at least one water-soluble carrier material;
   b) optionally metering in additional optional ingredients;
   c) Metering in, preferably continuously metering in the at least one fragrance, the at least one rheology modifier from the group of heteroglycans and optionally a dye into the melt;
   d) mixing the melt and the at least one fragrance;
   e) applying drops of the resulting mixture to a cooling belt by means of a drop former having a rotating, perforated outer drum; and
   f) solidifying the drops of the mixture on the steel belt to form solid melt bodies.

EXAMPLES

Example 1

The following table contains sample formulations of compositions according to the invention (all data in wt %)

TABLE 1

| Compositions | | | |
|---|---|---|---|
| | E1 | E2 | E3 |
| Sodium acetate (water-free) | 53.0 | 53.0 | 53.0 |
| Water | 34.8 | 34.8 | 34.8 |
| Succinoglycan | 1.5 | 1.5 | 1.5 |
| Dipropylene glycol | 1.7 | 1.7 | 1.7 |
| Tris(hydroxymethyl)aminomethane (TRIS) | 1.9 | 1.9 | 1.9 |
| Fragrance | 6.96 | | 1.86 |
| Fragrance capsule slurry (50%) | | 6.96 | 5.1 |
| Dye | 0.1 | 0.1 | 0.1 |
| Bitter substance | 0.04 | 0.04 | 0.04 |

For the preparation, the sodium acetate was dissolved in water at a temperature of 70° C. with stirring. Subsequently, the other constituents were incorporated. Pastilles were prepared by dropping the liquid mixture ("melt") onto a cooling plate that is temperature-controlled to room temperature (23° C.).

What is claimed is:

1. A solid, particulate composition comprising, based on the total weight of the composition,
   a) 20 to 95 wt % of at least one water-soluble carrier material selected from water-containing salts whose water vapor partial pressure corresponds, at a specific temperature in the range of from 30 to 100° C., to the $H_2O$ partial pressure of the saturated solution of said salt;
   b) 0.1 to 20 wt % of at least one fragrance;
   c) 0.1 to 10 wt % of at least one rheology modifier from the group of heteroglycans, of such a type and in such an amount that a melt obtained by heating the composition to 70° C. has a yield point above 1 Pa;
   d) optionally up to 25 wt % of an emulsifier;
   e) optionally up to 25 wt % of at least one solid or filler that is different from (c) and (d); and
   f) optionally at least one dye.

2. The composition according to claim 1, wherein the water-soluble carrier material is selected from hydrous salts whose water vapor partial pressure, at a temperature in the range from 40 to 90° C. corresponds to the $H_2O$ partial pressure of the saturated solution of this salt.

3. The composition according to claim 2, wherein the water vapor partial pressure of the hydrous salts is at a temperature in the range from 50 to 85° C.

4. The composition according to claim 2, wherein the water vapor partial pressure of the hydrous salts is at a temperature in the range from 55 to 80° C.

5. The composition according to claim 2, wherein the hydrous salt is sodium acetate trihydrate ($Na(CH_3COO).3H_2O$).

6. The composition according to claim 1, wherein the water-soluble carrier material is contained in the composition in an amount from 30 to 95 wt % based on the total weight of said composition.

7. The composition according to claim 6, wherein the water-soluble carrier material is contained in the composition in an amount from 40 to 90 wt % based on the total weight of said composition.

8. The composition according to claim 6, wherein the water-soluble carrier material is contained in the composition in an amount from 45 to 90 wt % based on the total weight of said composition.

9. The composition according to claim 1, wherein the at least one fragrance is contained in the composition in an amount from 1 to 20 wt %.

10. The composition according to claim 9, wherein the at least one fragrance is contained in the composition in an amount from 1 to 15 wt %.

11. The composition according to claim 9, wherein the at least one fragrance is contained in the composition in an amount from 3 to 12 wt %.

12. The composition according to claim 1, wherein it contains, based on its total weight, a rheology modifier from the group of heteroglycans in an amount from 1 to 2.5 wt %.

13. The composition according to claim 12, wherein it contains a rheology modifier in an amount from 1.2 to 2.0 wt %.

14. The composition according to claim 1, wherein it contains a heteroglycan originating from bacteria as a rheology modifier.

15. The composition according to claim 1, wherein it contains an exopolysaccharide as a rheology modifier.

16. The composition according to claim 1, wherein the composition as a rheology modifier contains a compound with the INCI name succinoglycan.

17. The composition according to claim 1, wherein the melt obtained by heating the composition to 70° C. has a yield point above 5 Pa.

18. The composition according to claim 1, wherein the melt obtained by heating the composition to 70° C. has a yield point above 10 Pa.

19. The composition according to claim 1, wherein the emulsifier is selected from the group of fatty alcohols, fatty alcohol alkoxylates, fatty amide ethoxylates, fatty alcohol sulfates, fatty alcohol ether sulfates, alkylbenzene sulfonates, allyl polyglycosides, fatty acid sorbitan esters, alkylamine oxides, alkyl betaines or combinations thereof.

20. A method for preparing the composition according to claim 1, comprising:

a) producing a melt comprising the at least one water-soluble carrier material;

b) optionally metering in additional optional ingredients;

c) metering in the at least one fragrance, the at least one rheology modifier and optionally a dye into the melt;

d) mixing the melt and the at least one fragrance; and e) cooling and optionally reshaping the mixture to obtain fragrance-containing melt bodies.

* * * * *